US006216892B1

(12) United States Patent
Grandclement

(10) Patent No.: US 6,216,892 B1
(45) Date of Patent: Apr. 17, 2001

(54) SHELF UNIT

(75) Inventor: Charly Grandclement, Oyonnax (FR)

(73) Assignee: Grosfillex S.A.R.L., Oyonnax (FR)

( * ) Notice: Subject to any disclaimer, the term of this patent is extended or adjusted under 35 U.S.C. 154(b) by 0 days.

(21) Appl. No.: 09/468,359

(22) Filed: Dec. 21, 1999

(30) Foreign Application Priority Data

Dec. 23, 1998 (FR) ..... 98 16311

(51) Int. Cl.[7] ..... A47B 43/00

(52) U.S. Cl. ..... 211/186; 211/187; 248/250; 108/109; 108/147.18

(58) Field of Search ..... 108/109, 147.18, 108/107; 211/186, 187, 192; 248/250

(56) References Cited

U.S. PATENT DOCUMENTS 3,012,678 * 12/1961 Fiege .
3,326,149 * 6/1967 Mitchell et al. .
3,565,020 2/1971 Schier et al. .
4,076,203 2/1978 McDonnell .
4,356,777 * 11/1982 Kellogg .
4,736,919 * 4/1988 Bessinger ..... 248/250
5,358,206 * 10/1994 Pittella ..... 248/250

FOREIGN PATENT DOCUMENTS 85 09 130 6/1985 (DE) .
1270138 12/1961 (FR) .

* cited by examiner

*Primary Examiner*—Robert W. Gibson, Jr.
(74) *Attorney, Agent, or Firm*—Gary M. Nath; Todd L. Juneau; Marvin C. Berkowitz

(57) ABSTRACT

A shelf unit comprising uprights and shelves. The uprights are formed by two flanks each provided with a plurality of windows into which the ends of the shelves can be inserted, such that, at each end of a shelf, clearance is provided between a horizontal "locking" face of the shelf and a "locking" edge of the window, which edge faces the locking face. For each shelf, the unit is provided with at least two locking elements, one for each end of the shelf, each locking element comprising a clamping member suitable for being inserted between the locking face of the shelf and the locking edge of the window, and for being displaced so as to come into contact with said locking face for locking the shelf.

13 Claims, 4 Drawing Sheets

FIG.2
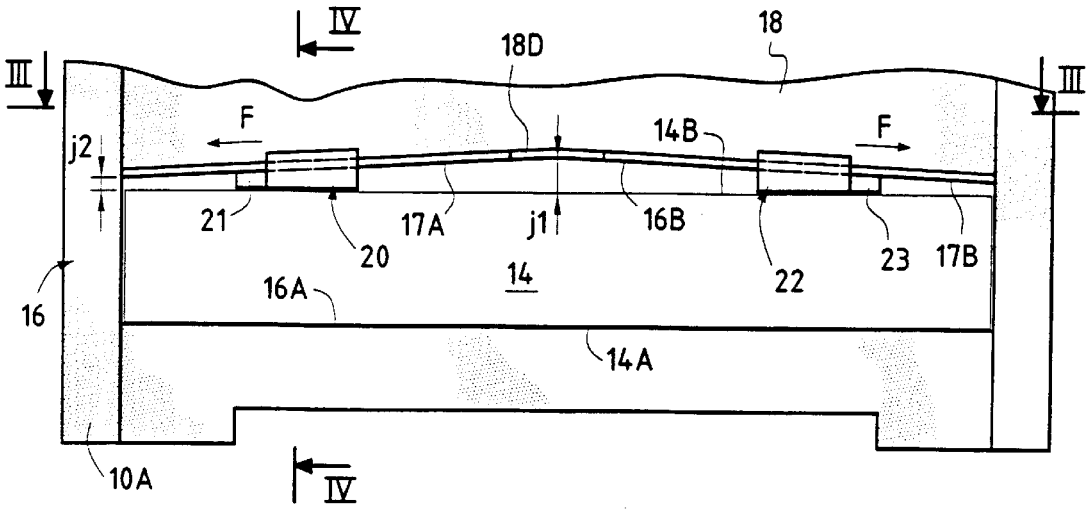
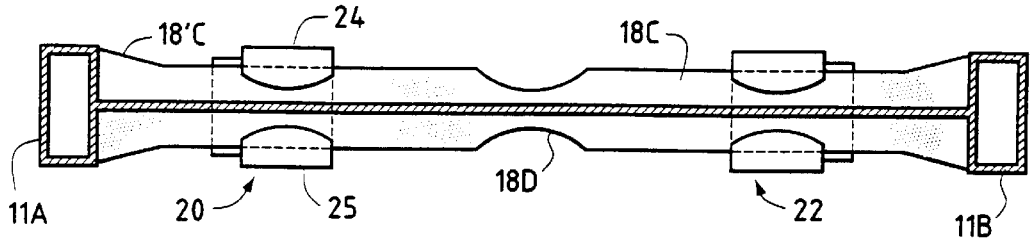
FIG.3
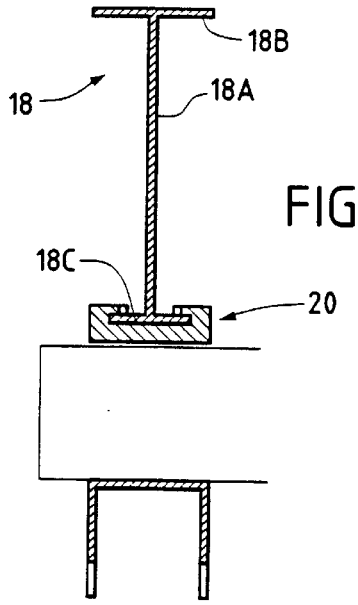
FIG.4
FIG.5
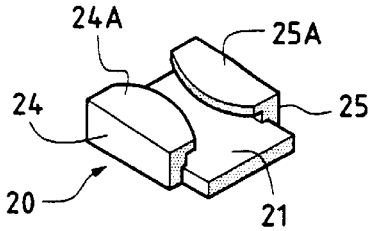

SHELF UNIT

The present invention relates to a shelf unit comprising uprights and shelves suitable for being connected to said uprights to form shelving.

BACKGROUND OF THE INVENTION

Units of that type are known, in which the shelves are fixed to the uprights in various manners. Units exist in which the shelves are not adjustable, in which case battens or the like or used as fixing systems for fixing the shelves. Units also exist in which the uprights are in a plurality of portions, each of which is equipped with end-pieces that co-operate with bores provided at all four corners of the shelves.

Units also exist in which the shelves are adjustable, and in which the shelves rest on rests which can be displaced vertically along racks provided on the uprights.

OBJECTS AND SUMMARY OF THE INVENTION

An object of the present invention is to provide a shelf unit that uses a different system for mounting the shelves on the uprights, which system is extremely simple.

This object is achieved by the fact that the uprights are formed by two flanks each provided with a plurality of windows into which the ends of the shelves are suitable for being inserted, such that, at each end of a shelf, clearance is provided between a horizontal "locking" face of the shelf and a "locking" edge of the window, which edge faces the locking face, and by the fact that, for each shelf, said unit is provided with at least two locking elements, one for each end of the shelf, each locking element comprising a clamping member suitable for being inserted between the locking face of the shelf and the locking edge of the window, and for being displaced so as to come into contact with said locking face for locking the shelf.

The uprights are shaped rather like ladders whose horizontal bars or "rungs" serve to hold the shelves of the shelving. For this purpose, the ends of the shelves are inserted into windows provided between two successive bars, and they are wedged in this position by locking elements. The bars provided between the windows form successive levels on which to position the shelves. Thus, depending on the vertical spacing between two successive windows, it is possible to dispose a shelf in each of the windows, or else to dispose shelves in only some of the windows, so as to select the spacings between the shelves.

Advantageously, each window has a horizontal bottom edge forming a bottom bearing surface for the end of a shelf, the locking edge being the top edge of the window.

Thus, the bottom surface of each shelf rests on the bottom edge of a window, which edge also forms the top edge of a bar. When manufacturing the uprights, it is easy to dimension the bottom edges of the windows such that they form bearing surfaces of area sufficient to support the shelves with a given load.

In an advantageous configuration, the unit includes means for fixing the locking elements to the flanks forming the uprights while enabling the locking elements to be moved relative to the locking edges of the windows.

This makes it easier both to assemble and to disassemble the shelf unit. Once the locking elements have been fixed to the uprights, the various component parts of the shelf unit can be handled without any danger of losing a locking element. The uprights can be delivered with the locking elements already in place for each window. It is also possible to make provision for the unit to be delivered with a given number of locking elements that corresponds to the number of shelves to be installed, and for the user to fix the locking elements to the uprights prior to installing the shelves.

Advantageously, the clamping members are in the form of clamping wedges.

The clamping wedges may be inserted between the shelves and the facing locking edges, and locking is obtained merely by displacing the clamping wedges while taking account of the direction in which they slope.

BRIEF DESCRIPTION OF THE DRAWINGS

The invention will be better understood, and its advantages will appear more clearly on reading the following detailed description of embodiments shown by way of non-limiting example. The description makes reference to the accompanying drawings, in which:

FIG. 2 is a fragmentary view looking along arrow II of FIG. 1;

FIG. 3 is a horizontal section view on line III—III of FIG. 2;

FIG. 4 is a vertical section view on line IV—IV of FIG. 2;

FIG. 5 is a perspective view showing a locking element;

MORE DETAILED DESCRIPTION

Figure 1:
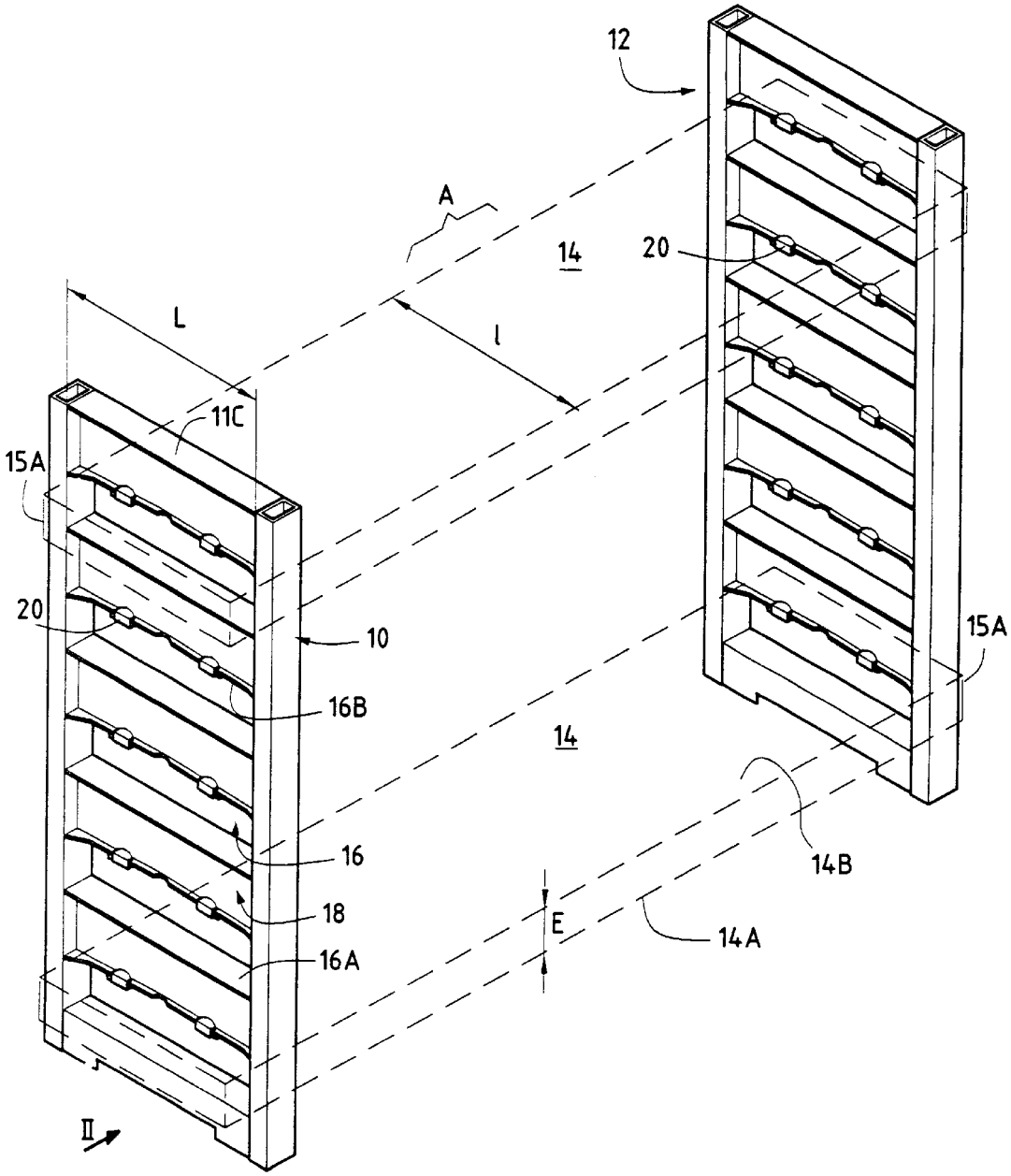
FIG. 1 is a perspective view showing a shelf unit of the invention.

FIG. 1 shows the two uprights 10 and 12 of a shelf unit, the shelves 14 of which are merely outlined in dashed lines. The uprights 10 and 12 are formed by two identical flanks. Each of them is provided with a plurality of windows 16 which are disposed one above another and which all have the same dimensions. The length L of a window, as measured in the depth direction of the unit, is at least equal to the width l of each of the shelves (it can be slightly greater). In the height direction, each of the windows has a height that is slightly greater than the thickness E of a shelf. Thus, as can be seen for the bottom windows and for the top windows of the uprights, the ends 15A of the shelves can be inserted into said windows, over the entire width of said ends.

The uprights 10 and 12 can thus be likened to ladders, the wall elements 18 situated between two consecutive windows 16 forming the rungs of the ladders, said windows being delimitated on each side thereof by respective posts analogous to upright bars of a ladder.

FIG. 2 shows more clearly the shape of the window 16 with which the bottom end 10A of the upright 10 is provided. It also shows the bottom region of the wall element 18 situated immediately above said window.

The end of a shelf 14 is inserted into the window 16. It can be seen that the bottom face 14A of the shelf rests on the horizontal bottom edge 16A of the window, which edge thus forms a bottom bearing surface for the shelf. The locking face of the shelf is its top face 14B, and it can be seen that clearance is provided between said top face 14B and that edge 16B of the window 16 which faces it. This locking edge 16B is the top edge of the window 16.

In the example shown, the clearance between the face 14B and the edge 16B is of height that varies between a maximum height $j_1$, in a middle region of the window and a minimum height $j_2$, at the front and rear ends of the window.

The edge 16B is thus V-shaped, with the tip of the V pointing upwards, and its two branches forming two ramps 17A and 17B that slope relative to the horizontal.

The unit is provided with two locking elements 20 and 22 at each of the ends of each shelf, i.e. with four locking elements per shelf.

In general, it is necessary to provide at least one locking element for each end of each shelf. As shown in FIG. 2, each locking element 20 or 22 includes a portion that is inserted between the locking face 14B of the shelf and the locking edge 16B of the window. The arrows F indicate that the locking elements may be displaced by sliding them along the ramps 17A and 17B so as to lock the shelf.

The portions of the elements 20 and 22 that are inserted between the shelf and the locking edge are designated respectively in FIG. 2 by the references 21 and 23. It can be seen that they slope so that they form wedges. It is thus easy to see that the shape of the elements 21 and 22, combined with the decreasing clearance between the locking edge 16B and the top face 14B of the shelf, enable the shelf to be locked in the window 16 once the locking elements 20 and 22 have been slid to the ends of their strokes.

In the variant shown in FIGS. 1 to 5, the locking elements are constituted by sliders for which the locking edges 16B form rails.

In vertical section, the wall elements 18 are I-shaped in overall shape. Each of them thus has a central web 18A which forms the vertical bar of the I, and two cross bars 18A and 18C which form the top and bottom bars of the I.

Via its top face, the top cross bar 18B defines the bottom edge of a first window, while the bottom cross bar 13C defines the top edge of another window situated under the first window, and of which it forms the locking edge.

The locking elements 20 and 22 are provided with side flanges 24 and 25 whose free ends 24A and 25A extend inwards to form lips overlying the top faces of the wedges 21.

Thus, the locking elements are disposed such that the bottom bar 18C is engaged under the lips 24A and 25, thereby enabling them to slide.

In FIGS. 1 to 3, it can be seen that that portion of each of the bottom bars 18C which is in the middle relative to the depth direction of the unit has notches so that, in order to install a locking element 20, it is necessary merely to dispose it under the bar 18C by placing the lips 24A and 25B in register with the notches 18D, and then to push it upwards prior to moving it in the direction indicated by the arrows F.

In this situation, the bottom bar is held captive between the lips. The notches 18D thus facilitate installation of the locking elements, which is particularly advantageous if the unit is delivered with only that number of locking elements which corresponds to the number of shelves, and if, to assemble the unit, the user must dispose the locking elements on the locking edges of those windows into which the user wishes to insert the shelves.

It is also possible to consider other ways of installing the locking elements, e.g. by clipping or the like. In any event, it can be understood that once the locking elements have been installed so that the bottom bars 18C are engaged under the lips, it is possible to handle the component parts of the unit without any danger of the locking elements being lost.

It can be seen in FIG. 3 that the bottom bar 18C flares at its ends 18'C, which determines the extreme advancement positions of the locking elements 20 and 22, beyond which positions they cannot advance towards said ends.

The various component parts of the shelf unit may be made of a plastics material. In order to limit the manufacturing costs and the weight of the unit, the thicknesses of the parts are as small as possible, and it can thus be seen in FIG. 3 that the posts 11A and 11B that form the side ends of the flanks are hollow. For example, each of the flanks may be molded in one piece. Advantageously, the posts 11A and 11B are hollow through from end to end, thereby facilitating the manufacture of the uprights of the unit.

Figure 9:
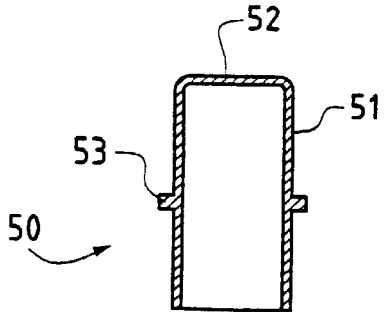
FIG. 9 shows an assembly element suitable for being fitted to the uprights of the unit of the invention.

FIG. 9 shows an end-piece 50 that may be disposed at the top end of each of the posts. The end-piece is in the form of a substantially tubular element, one end 52 of which is closed.

The end-piece may be fitted to the top end of a post 11A or 11B. In the example shown, the end-piece may be engaged in said top end while being held in place by abutment by means of a bead 53 provided on its axial wall 51.

The end-piece 50 may serve to finish a post by means of its closed end wall 52. It may also serve to assemble together two posts disposed one above the other. The bottom end of the top upright then overlies the end-piece while being retained by the bead 53.

It is thus possible to use the unit as a modular element assembled together with elements of the same type on either side and above and below it.

The shelves are also advantageously made of plastic; they may be molded or blown. However, they are advantageously made in long lengths, by extrusion, and then cut to the desired length. In which case, finishing trim may be installed on the edges of the shelves.

It should be noted that it is quite possible to dispose intermediate uprights in middle regions of long shelves, e.g. in the region A indicated in FIG. 1. The locking elements are easy to manipulate in order to adjust the positions of the intermediate uprights and the spacing between them and the other uprights, as a function of the load on the shelves.

In general, in the first embodiment, the locking edge 16B of each window has at least one ramp sloping relative to the horizontal such that the clearance provided between the locking edge and the locking face 14B of a shelf 14 inserted in the window decreases between a first and a second end of said ramp.

In the example shown, the locking edge 16B actually has two ramps, respectively 17A, 17B which form an upside-down V whose angle at its tip is very wide (e.g. about 178°), the first ends of the ramps being situated in a middle portion of the locking edge 16B, substantially at the place where the clearance $j_1$ is indicated, while their second ends are situated in the vicinities respectively of the front end and of the rear end of the locking edge, in the depth direction of the unit.

Figure 6:
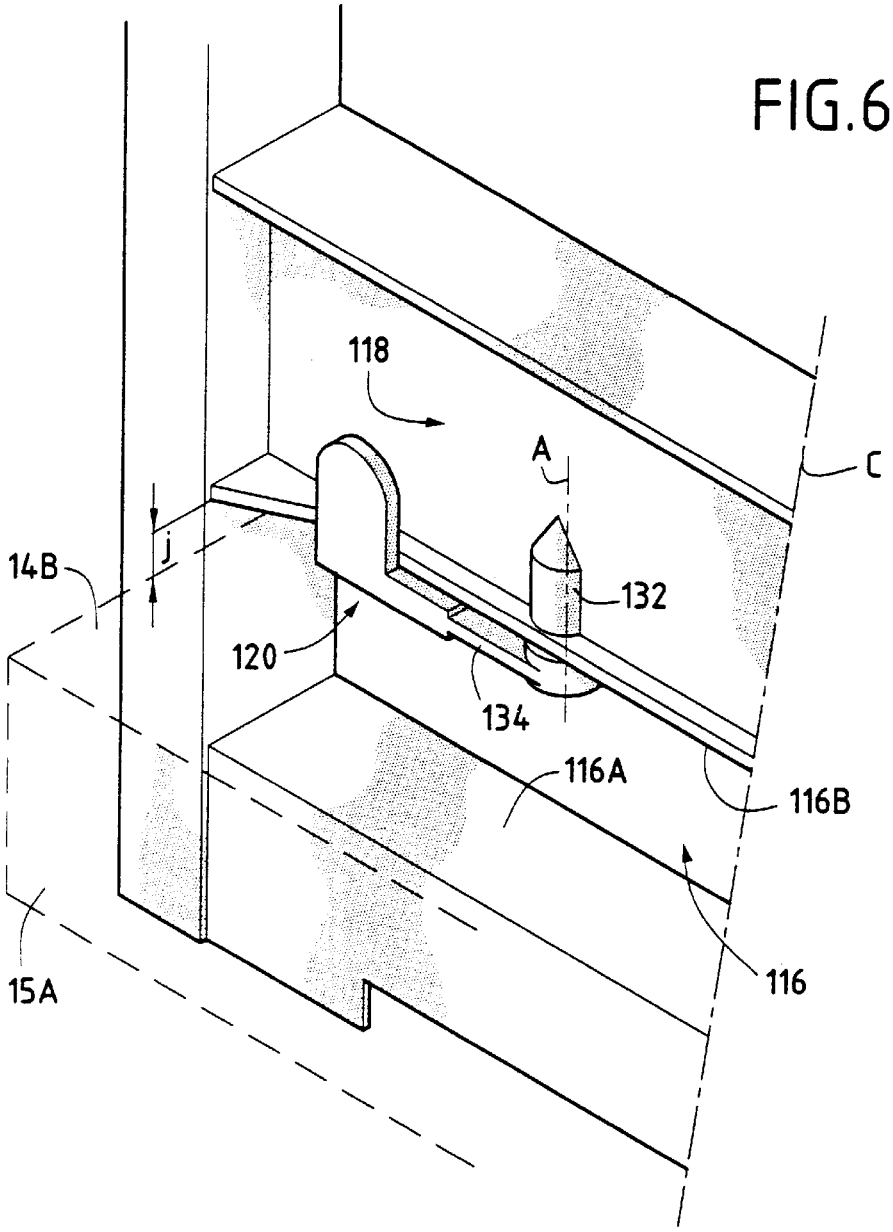
FIG. 6 is a fragmentary perspective view showing another embodiment.
Figure 7:
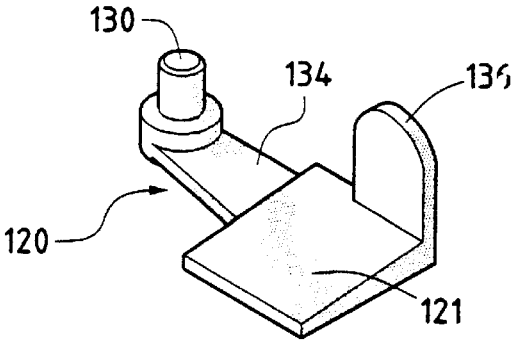
FIG. 7 shows a locking element as in the embodiment shown in FIG. 6.

FIGS. 6 and 7 show a second embodiment. FIG. 6 shows the end 15A of a shelf 14, as inserted in a window 116. The shape of the uprights is substantially analogous to that of the uprights shown in FIG. 1 to 5, and the same I-structure is shown for the wall elements 118 situated between two consecutive windows 116.

The bottom edge 116A of each of the windows is horizontal and forms a bearing surface for a shelf. The differences between the embodiment shown in FIGS. 1 to 5 and the embodiment shown in FIG. 6 lie in the disposition of each of the locking elements and in the shape of the locking edges.

Unlike the locking edges 16B of the first embodiment, the locking edges 116B are substantially horizontal. The number of locking elements 120 is also substantially two per shelf end. FIG. 6 is interrupted in a region in the middle of the unit, in the depth direction. It can be completed by symmetry about the vertical line C.

The locking elements 120 also include wedge-shaped clamping elements 121, the top faces of which slope. The wedge is integral with a stud 130 suitable for being mounted in the vicinity of the locking edge 116B of the window, so that the wedge 121 can be inserted into the clearance j provided between the locking edge 116B and the locking face 14B of the shelf that is inserted in said window, by being swung about the substantially vertical axis A of said stud.

For the purpose of fixing the locking element to the wall element 118, said wall element is provided with a recess forming a sleeve 132 that is open facing downwards. Optionally, means are provided for retaining the stud in the sleeve. For example, the stud may be engaged under force into the sleeve, and it may optionally be provided with an annular retaining bead. The wedge 121 is connected to the stud 130 via a connection arm 134, so that the locking element is formed in a single piece. Said arm is of relatively small thickness so as to impart flexibility to the part.

Advantageously, the locking elements are provided with handling surfaces. Thus, the locking element 120 shown in FIGS. 6 and 7 may be provided with a substantially vertical tab 136 on that one of its faces which is rearmost relative to the direction in which the locking element is swung to lock the shelf by means of the wedge. Similarly, the flanges 24 and 25 of the locking element 20 shown in FIG. 5 are disposed to project from the sides so as to make the element easier for the user to grasp for the purpose of sliding it.

Figure 8:
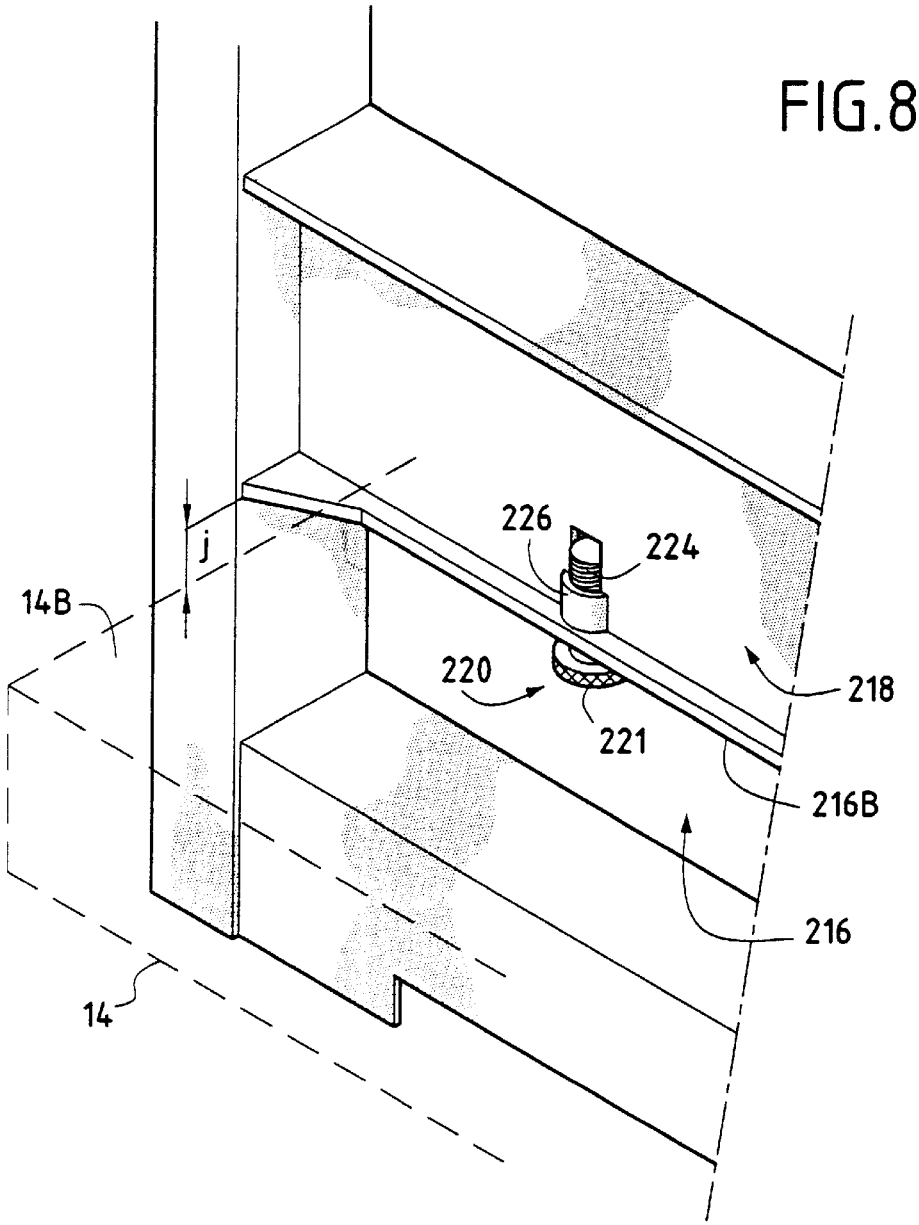
FIG. 8 is a view analogous to the FIG. 6 view, showing yet another embodiment.

FIG. 8 is a view analogous to FIG. 6 showing another embodiment. The windows 216 are analogous to the windows 116, the clearance j being provided between the top face 14B of the shelf 14 and the locking edge 216B. The clamping element 220 includes a knurled wheel 221 that is carried by a threaded rod 224. This rod co-operates with a nut 226 which is secured to or integral with the locking edge 216B. For example, the nut may be implemented in the form of a tapped sleeve formed in one piece with the wall element 218 of the upright. It should be understood that the knurled wheel 221 is suitable for being moved towards or away from the locking edge 216B by tightening or loosening the threaded rod in said nut. The knurled wheel can thus co-operate with the top face 14B of the shelf 14 to lock said face relative to the upright.

What is claimed is:

1. A shelf unit comprising uprights and shelves having ends, said shelves being suitable for being connected to said uprights to form shelving;

wherein the uprights comprise two flanks each provided with a plurality of openings having a height and a depth, wherein said depth of said plurality of openings is equal to or slightly greater than a depth of said shelves, ends of said shelves being suitable for being inserted into corresponding ones of said plurality of openings, wherein at each end of each said shelf clearance is provided between a horizontal locking face of said shelf and a corresponding locking edge of said corresponding opening, wherein said locking edge faces said locking face, and wherein, for each said shelf, said shelf unit is provided with at least two locking elements, one of said at least two locking elements for each end of each said shelf, each said locking element comprising a clamping member suitable for being inserted between the locking face of the shelf and the locking edge of the opening, said clamping member being displaceable so as to come into contact with said locking face for locking the shelf.

2. A shelf unit according to claim 1, wherein each of said plurality of openings has a horizontal bottom edge defining a bottom bearing surface to support the corresponding end of said corresponding shelf, and wherein the locking edge is a top edge of said opening.

3. A shelf unit according to claim 1, further including means for fixing the at least two locking elements to the upright's flanks while said at least two locking elements each remain movable relative to the locking edges of the plurality of openings.

4. A shelf unit according to claim 1, wherein the clamping members further comprise clamping wedges.

5. A shelf unit according to claim 1, wherein the locking edge of each of said plurality of openings has a ramp sloped relative to a horizontal direction wherein after one end of one of said shelves is disposed in a corresponding one of said openings a clearance provided between the locking edge of said opening and the locking face of said corresponding shelf decreases from a first end of the ramp to a second end of the ramp, and wherein the unit includes means for sliding said clamping member over said ramp.

6. A shelf unit according to claim 5, wherein each of said plurality of openings has a horizontal bottom edge defining a bottom bearing surface to support the corresponding end of said corresponding shelf, and wherein the locking edge is a top edge of said opening.

7. A shelf unit according to claim 5, wherein the locking edge of each of said plurality of openings has two ramps each having its respective first end disposed near a middle portion of the locking edge, a second end of one of said two ramps being disposed near a front end of said locking edge and a second end of another of said two ramps being disposed near a rear end of said locking edge.

8. A shelf unit according to claim 1, wherein each of said plurality of openings has a slide rail disposed parallel to said locking edge, and wherein each clamping member has a slider co-operating with said slide rail.

9. A shelf unit according to claim 5, wherein each of said plurality of openings has a slide rail disposed parallel to said locking edge, and wherein each clamping member has a slider co-operating with said slide rail.

10. A shelf unit according to claim 7, wherein each of said plurality of openings has a slide rail disposed parallel to said locking edge, and wherein each clamping member has a slider co-operating with said slide rail.

11. A shelf unit according to claim 3, wherein said clamping members further comprise clamping wedges, and wherein each said clamping wedge is integral with a stud fixed proximate to the locking edge of one of said plurality of openings, whereby said clamping wedge can be inserted between the locking edge of said one of said plurality of openings and the locking face of the corresponding shelf inserted in said opening by being pivoted about a substantially vertical axis of said stud.

12. A shelf unit according to claim 1, wherein said locking elements further comprise handling surfaces.

13. A shelf unit according to claim 3, wherein each of said clamping elements includes a knurled wheel carried by a threaded rod cooperatively engaged with a nut that is secured to the locking edge of one of said plurality of openings, said knurled wheel being displaceable relative to said locking edge by an axial rotation of said threaded rod in said nut.

* * * * *